United States Patent [19]

Schonbrun

[11] 4,041,622

[45] Aug. 16, 1977

[54] SNOWSHOE

[76] Inventor: David M. Schonbrun, 1100 E. Union, Seattle, Wash. 98122

[21] Appl. No.: 726,995

[22] Filed: Sept. 27, 1976

[51] Int. Cl.[2] ..... A43B 5/04

[52] U.S. Cl. ..... 36/124

[58] Field of Search ..... 36/122, 123, 124, 125

[56] References Cited

U.S. PATENT DOCUMENTS

| | | | |
|---|---|---|---|
| 1,038,264 | 9/1912 | Baker | 36/122 |
| 3,638,333 | 2/1972 | Sprandel | 36/125 |

*Primary Examiner*—Patrick D. Lawson

*Attorney, Agent, or Firm*—Seed, Berry, Vernon & Baynham

[57] ABSTRACT

A lightweight snowshoe is disclosed utilizing longitudinally extending spaced apart frame members having a cross-section in the form of a rectangle, preferably with concave sidewalls and end walls. Spaced countersunk openings are provided along the length of the frame member to receive webbing which criss-crosses the area between the frame members. The frame members are flexible along their minor axes but substantially rigid along their major axes. When the weight of the wearer is imposed on the webbing, the flexing of the frame members allows the webbing to sag downwardly to contact the snow and form a traction surface to prevent forward or backward slippage. When the weight on the webbing is relieved the frame members spring back to their original position. The lower edges of the frame members have relatively sharp edges to penetrate the snow and prevent side slippage when traversing sloping terrain.

4 Claims, 5 Drawing Figures

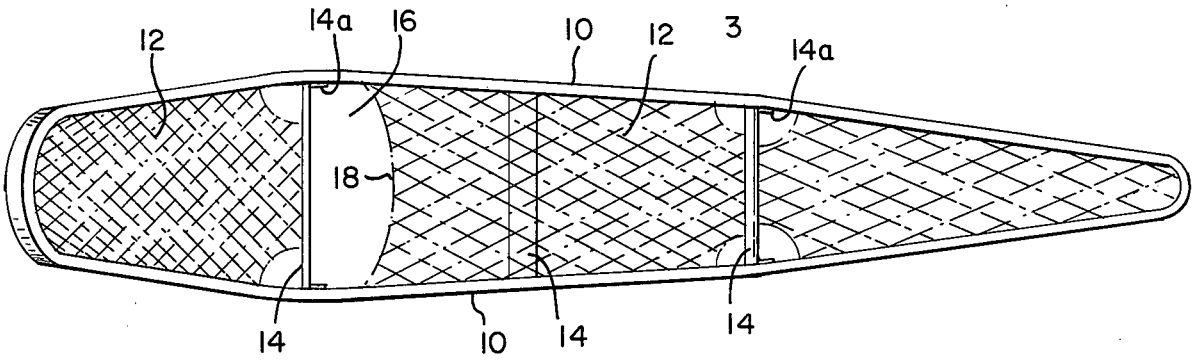
FIG. 1
FIG. 2
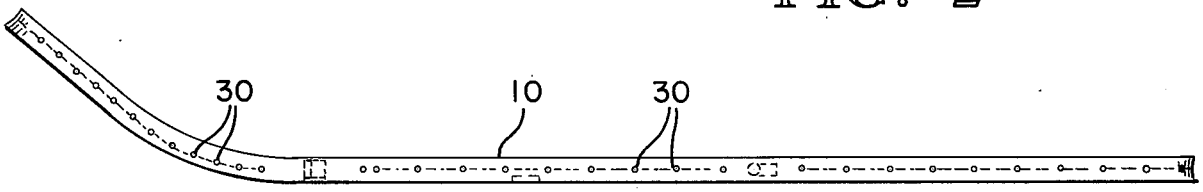
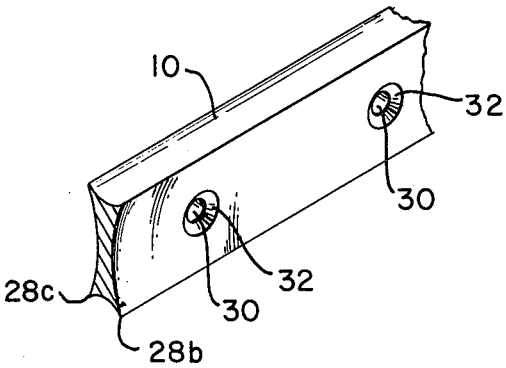
FIG. 5
FIG. 4
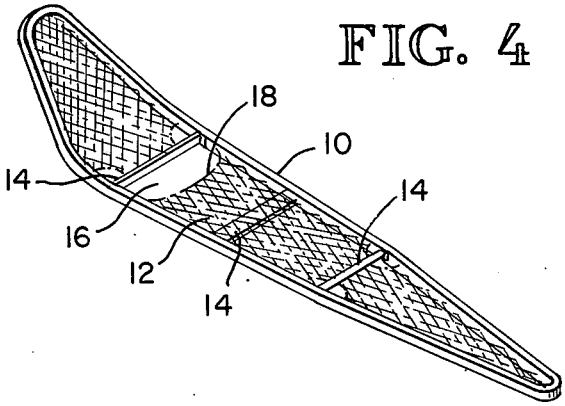
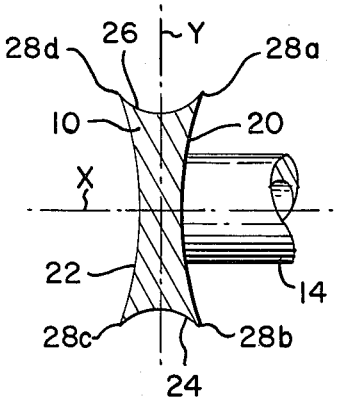
FIG. 3

SNOWSHOE

BACKGROUND OF THE INVENTION

1. Field of the Invention

This invention relates to an improved lightweight snowshoe.

2. Prior Art Relating the Disclosure

Conventional snowshoes utilize frame members made of wood and/or metal, the wood frames generally square, and the metal frames having a tubular cross-section. The webbing which criss-crosses the snowshoe between the frame members is wrapped around the outer surface of the frame members, at least over a portion thereof, to provide a greater amount of traction when walking up or down inclined terrain or traversing sloping terrain. The webbing along the wrapped portion is quickly worn and has to be replaced at frequent intervals. Conventional snowshoes have no means for gripping the snow when traversing sloping terrain; thus side slippage is a problem.

Designers and manufacturers of snowshoes have not recognized that the frame of snowshoes are loaded laterally of their longitudinal axis by application of the load through the webbing connecting the spaced frame members. Failing to recognize this, they have not designed snowshoes to use such loading to advantage in providing greater traction.

SUMMARY OF THE INVENTION

It is a primary object of this invention to provide a lightweight snowshoe having spaced frame members which are substantially rigid along their major axes but sufficiently flexible along their minor axes to allow the webbing criss-crossing the area between the frame members to sag downwardly and contact the snow when the weight of the wearer is imposed thereon, the frame members springing back to their original position on the release of the weight.

It is a further object of this invention to provide a lightweight snowshoe having spaced apart frame members with relatively sharp lower edges which contact and penetrate the snow to prevent side slippage when traversing across inclined terrain.

It is a further object of this invention to provide a lightweight snowshoe wherein the webbing criss-crossing between the frame members is not wrapped over and around the outer surface of the frame members at any point but is laced through spaced countersunk openings along the length of the frame members.

BRIEF DESCRIPTION OF THE FIGURES OF THE DRAWING

FIG. 1 is a top view of the snowhoe of this invention;

FIG. 2 is a side view of the snowshoe of FIG. 1;

FIG. 3 is a cross-section of the frame member of the snowshoe;

FIG. 4 is a perspective view of the snowshoe of FIG. 1; and

FIG. 5 is a perspective view of a section of the frame member of the snowshoe illustrating the countersunk openings.

DETAILED DESCRIPTION OF THE INVENTION

Referring to FIG. 1 the snowshoe comprises an outer encircling frame 10 which is criss-crossed by webbing 12 secured to the frame 10 and one or more of crossbars

14 extending between the sides of the frame to add stability to the webbing. The webbing includes an opening 16 at the forward end of the snowshoe defined by the frame 10, forward crossbar 14 and toe cord 18. The webbing, braces and frame allow the wearer to walk up on top of deep snow without sinking deeply into the snow.

The frame member of this snowshoe is made of a lightweight material such as aluminum, aluminum alloys, magnesium, steel, titanium or synthetic plastic such as ABS, polypropylene, etc. It is preferably a one-piece frame which is shaped after extrusion. The spaced frame members may be welded or riveted at their ends when metal frame members are used, but preferably are joined end-to-end by welding. The crossbars 14 may be bent at their respective ends to form flange portions 14a which are spotwelded to the spaced framed members when metal frame members are used. Other means of securing the crossbars to the spaced frame members may also be used depending on the materials employed.

The forward end of the snowshoe may be turned upwardly as illustrated to prevent the wearer from digging the snowshoe into the snow at unexpected intervals, particularly when walking in deep, powder snow.

FIG. 3 illustrates a cross-section of the frame member 10 of the snowshoe which is rectangular in congfiguration, preferably with concave sidewalls 20,22 and concave end walls 24,26. The intersections of the sidewalls and end walls form relatively sharp edges 28*a,b,c,d*. The frame member is flexible along its minor axis X but is substantially rigid and resists bending along its major axis Y. The flexibility of the frame member is advantageous in that the portion of the frame between the foward and rear cross-bars 14 flexes inwardly when the weight of the wearer is exerted on the webbing criss-crossing the area between the frame members. This allows the webbing to sag downwardly and contact the snow to form a traction surface therewith, preventing slippage of the snowshoes when traversing up or downhill. When the weight of the wearer on the webbing is released the frame members tend to spring back to their original position.

The relatively sharp edges 28*b* and 28*c* on the lower edges of the frame member are advantageous in that they bite into the snow and prevent slippage of the snowshoe laterally during traverse across an inclined area.

Spaced openings 30 are provided along the length of the frame members for interlacing of the webbing. Each of the openings is countersunk as illustrated at 32 so that the webbing does not encounter any sharp edges. The webbing is not wrapped over and around the frame member as it is true with many conventional showshoes but is wholly interlaced between the frame members through the openings 30. Conventional snowshoes have relied on the overlapped webbing to provide additional traction; however, lapping the webbing over the frame of the snowshoe results in abrasion and quick wearing of the webbing.

The snowshoe described herein, has a flexible frame which allows the webbing, under the weight of the wearer, to sag downwardly and contact the snow to form an effective traction surface superior to that obtained with conventional snowshoes. In addition the sharp lower edges of the frame members bite into the snow to prevent lateral slippage of the snowshoe when traversing inclined areas. The combination of these two features results in a snowshoe which provides greater traction and longer wear of the webbing. At the same time, it is lightweight and of superior strength.

The frame, webbing and lacing of the snowshoe may take any configuration desired. That which is shown in the drawing in only one form. Any harness may be used with the snowshoe. One particular harness, illustrated and described in U.S. Pat. No. 3,755,926, is preferred.

The embodiments of the invention in which a particular property or privilege is claimed are defined as follows:

1. A lightweight snowshoe providing good traction for the wearer over lever and inclined terrain comprising:

longitudinally extending spaced frame members joined together enclosing an area criss-cross by webbing, the frame member being of a configuration which is substantially rigid against bending along its major axis and flexible along its minor axis, the frame member further provided with sharp lower edges which penetrate the snow to prevent lateral slippage when traversing sloping terrain.

2. The snowshoe of claim 1, wherein the cross-section of the frame member is in the form of a rectangle with concave sidewalls and end walls.

3. The snowshoe of claim 1, including spaced openings along the frame members countersunk below the outer surface of the frame member, the openings adapted to receive the webbing interlaced between the frame members with the countersunk openings serving to prevent abrasion of the webbing where it contacts the frame members.

4. The snowshoe according to claim 1, wherein the flexibility of the frame member is sufficient to allow the webbing to sag downwardly relative to the frame and contact the snow due to the weight of the wearer, the webbing providing a traction surface with the snow.

* * * * *